US009980524B2

(12) United States Patent
Gallagher

(10) Patent No.: US 9,980,524 B2
(45) Date of Patent: May 29, 2018

(54) WOMAN'S UNDERGARMENT

(71) Applicant: Tara M. Gallagher, Bay Villiage, OH (US)

(72) Inventor: Tara M. Gallagher, Bay Villiage, OH (US)

( * ) Notice: Subject to any disclaimer, the term of this patent is extended or adjusted under 35 U.S.C. 154(b) by 0 days. days.

(21) Appl. No.: 13/964,521

(22) Filed: Aug. 12, 2013

(65) Prior Publication Data

US 2014/0041102 A1 Feb. 13, 2014

Related U.S. Application Data

(60) Provisional application No. 61/681,716, filed on Aug. 10, 2012.

(51) Int. Cl.
*A41B 9/04* (2006.01)
*A41B 9/00* (2006.01)

(52) U.S. Cl.
CPC ..... *A41B 9/04* (2013.01)

(58) Field of Classification Search
CPC ..... D04B 1/243; D04B 1/246; D04B 1/18; D04B 21/207; D04B 1/22; D04B 1/24; A41B 2400/38; A41B 9/06; A41B 9/00; A41B 9/001; A41B 9/04; A41B 11/14; A41B 2500/50; A41B 9/08; A41B 2500/10; A41C 1/02; A41C 3/08; A41C 1/04; A41C 1/10; A41C 3/128; A41C 1/00; A41D 1/20; A41D 1/22; A41D 2400/38; A41D 7/005; D10B 2501/02; D03D 15/08
USPC ..... 66/171, 177, 172 E, 176, 195, 169 R, 66/178 R, 170, 178 A, 182; 2/69, 311, 2/201, 406, 211, 409, 78.1, 113, 407, 2/239, 78.3; 450/93, 11, 155, 30, 7, 73, 450/85, 86, 10, 100, 115, 118, 131, 132, 450/14, 156, 8, 94, 96, 99
See application file for complete search history.

(56) References Cited

U.S. PATENT DOCUMENTS

| | | | | |
|---|---|---|---|---|
| 1,376,783 | A * | 5/1921 | Schoen | 2/46 |
| 1,552,733 | A * | 9/1925 | Rhoden | 2/71 |
| 2,736,036 | A * | 2/1956 | Sinigagliesi | 2/405 |
| 3,425,246 | A * | 2/1969 | Knohl | 66/171 |
| 3,906,754 | A * | 9/1975 | Sackman | 66/177 |
| 4,590,945 | A * | 5/1986 | Fiel | 450/31 |
| 4,663,946 | A * | 5/1987 | Wright | 66/177 |
| 5,566,392 | A * | 10/1996 | Dzelzkalns | 2/73 |
| 5,572,888 | A * | 11/1996 | Browder et al. | 66/171 |
| 5,590,548 | A * | 1/1997 | Osborne | 66/177 |
| 5,605,060 | A * | 2/1997 | Osborne | 66/171 |
| 5,667,422 | A * | 9/1997 | Erwin | 450/30 |
| 5,787,512 | A * | 8/1998 | Knox | 2/409 |
| 5,902,170 | A * | 5/1999 | Ganz | 450/94 |
| 6,276,175 | B1 * | 8/2001 | Browder, Jr. | 66/171 |
| 6,430,753 | B2 * | 8/2002 | Duran | 2/239 |
| 6,463,765 | B2 * | 10/2002 | Blakely | 66/178 R |
| 6,622,312 | B2 * | 9/2003 | Rabinowicz | 2/401 |
| 6,817,034 | B2 * | 11/2004 | Smilovic | 2/73 |
| 6,846,217 | B1 * | 1/2005 | Struble et al. | 450/31 |
| 7,017,376 | B2 * | 3/2006 | Meckley et al. | 66/171 |
| 7,048,013 | B2 * | 5/2006 | Shannon | 139/422 |

(Continued)

*Primary Examiner* — Bobby Muromoto, Jr.
(74) *Attorney, Agent, or Firm* — Tarolli, Sundheim, Covell & Tummino LLP

(57) ABSTRACT

An undergarment for women includes a main support portion and a slip portion joined with the main support portion to form a common, seamless waistline.

15 Claims, 7 Drawing Sheets

(56) References Cited

U.S. PATENT DOCUMENTS

| | | | | |
|---|---|---|---|---|
| 7,131,146 | B2 * | 11/2006 | Chatman | 2/78.1 |
| 7,181,775 | B2 * | 2/2007 | Carney | 2/311 |
| 7,260,961 | B1 * | 8/2007 | Kennedy | 66/177 |
| 7,395,557 | B1 * | 7/2008 | Ledyard | 2/113 |
| D583,529 | S * | 12/2008 | Gardner et al. | D2/704 |
| 8,191,177 | B1 * | 6/2012 | Carney | 2/311 |
| 8,235,766 | B2 * | 8/2012 | Melarti et al. | 450/155 |
| 8,276,216 | B2 * | 10/2012 | Carney | 2/311 |
| 8,430,830 | B1 * | 4/2013 | Ariza | 602/19 |
| 8,721,388 | B2 * | 5/2014 | Quaranta | 450/69 |
| 8,827,764 | B2 * | 9/2014 | Caruso et al. | 450/30 |
| 2001/0054303 | A1 * | 12/2001 | Browder, Jr. | 66/171 |
| 2002/0152775 | A1 * | 10/2002 | Browder, Jr. | 66/170 |
| 2004/0049831 | A1 * | 3/2004 | Smilovic | 2/211 |
| 2004/0237597 | A1 * | 12/2004 | Oya et al. | 66/195 |
| 2006/0166600 | A1 * | 7/2006 | Ravoiu et al. | 450/7 |
| 2007/0101481 | A1 * | 5/2007 | Stokesbary | 2/211 |
| 2007/0249265 | A1 * | 10/2007 | Delgado-Mecinas | 450/156 |
| 2008/0229474 | A1 * | 9/2008 | Fons et al. | 2/113 |
| 2009/0017722 | A1 * | 1/2009 | Ravoiu et al. | 450/11 |
| 2009/0171259 | A1 * | 7/2009 | Soerensen et al. | 602/67 |
| 2009/0181599 | A1 * | 7/2009 | Farmer et al. | 450/39 |
| 2009/0247046 | A1 * | 10/2009 | Fine | 450/30 |
| 2009/0270012 | A1 * | 10/2009 | Melarti et al. | 450/8 |
| 2010/0105284 | A1 * | 4/2010 | Policaro et al. | 450/33 |
| 2010/0184355 | A1 * | 7/2010 | Kennedy | 450/31 |
| 2011/0239353 | A1 * | 10/2011 | Carney | 2/311 |
| 2012/0144548 | A1 * | 6/2012 | Quaranta | 2/69 |

* cited by examiner

WOMAN'S UNDERGARMENT

CROSS-REFERENCE TO RELATED APPLICATION

This application claims the benefit of U.S. Provisional Patent Application No. 61/681,716, filed Aug. 10, 2012 and entitled WOMEN'S UNDERGARMENT, which is incorporated herein by reference in its entirety.

TECHNICAL FIELD

The present disclosure relates generally to an undergarment for women and, more particularly, to an undergarment for women that prevents seeing through a skirt or dress, particularly in sunlight, in a comfortable, multi-functional way.

BACKGROUND

Various styles of underwear have been used for many years. Conventional underwear is made of woven fabric or knitted and then cut and tailored with bulky seams. This process produces various underwear styles for women in a variety of sizes and fits. Conventional underwear with seams, especially those that are thicker, can interact with the wearer to cause significant discomfort, particularly when the wearer is combining several layers of undergarments to achieve a smooth appearance under the wearer's clothes. Underwear can also be knit as one piece on a circular knitting machine to produce a seamless garment. These processes produce undergarments in many varieties of size and fit. When wearing conventional or seamless underwear, the wearer will often need to combine multiple layers or garments to achieve a sleek, smooth and opaque appearance under clothes. This causes extra bulk, thickness, and discomfort for the wearer. With many fabrics and particularly in sunlight, a woman's silhouette and underwear can be visible.

SUMMARY

The present disclosure is generally directed to an undergarment for women and, more particularly, to an undergarment for women that prevents seeing through a skirt or dress, particularly in sunlight, in a comfortable, multi-functional way.

In accordance with an embodiment of the present disclosure, an undergarment for women includes a main support portion and a slip portion joined with the main support portion to form a common seamless waistline.

In accordance with another embodiment of the present disclosure, a single undergarment for women configured to be worn under a piece of clothing includes a main support portion and a slip portion sharing a seamless waistband with the main support portion.

BRIEF DESCRIPTION OF THE DRAWINGS

The foregoing and other features and advantages of the present disclosure will become apparent to one skilled in the art upon consideration of the following description of the disclosure and the accompanying drawings, in which.

DETAILED DESCRIPTION

Figure 1:
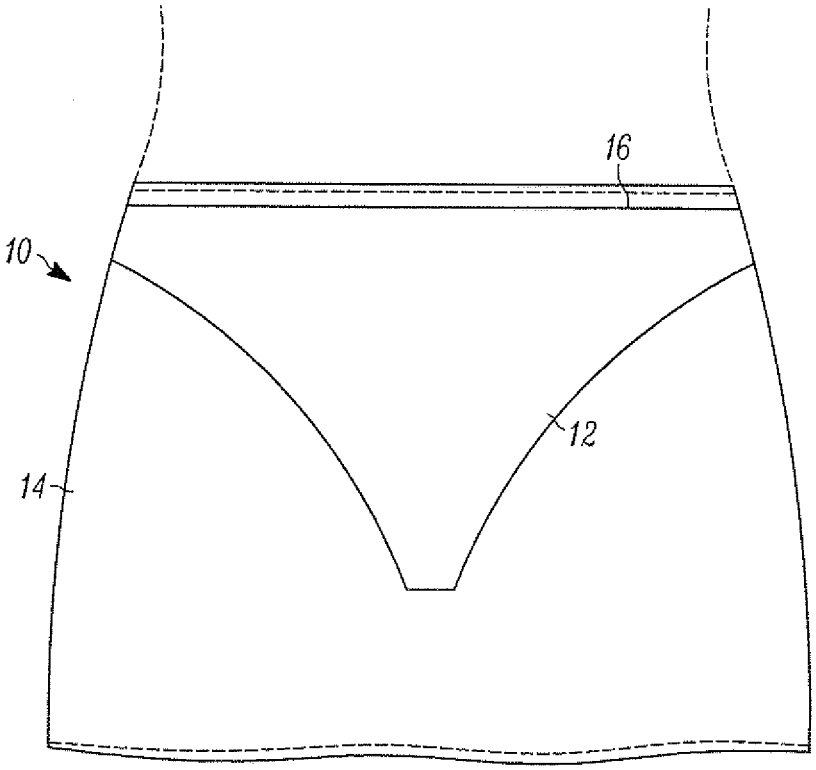
FIG. 1 is a schematic illustration showing an undergarment for women in accordance with one aspect of the present disclosure.

The present disclosure relates generally to an undergarment for women and, more particularly, to an undergarment for women that prevents seeing through a skirt or dress, particularly in sunlight, in a comfortable, multi-functional way. As representative of one aspect of the present disclosure, FIG. 1 shows an undergarment 10 configured to be worn under a woman's clothing. As described below, the undergarment 10 includes a main support portion 12 and a slip portion 14 joined with the main support portion to form a common, seamless waistline 16. Not only does the undergarment 10 include multiple layers and is opaque so that it is comfortable and not able to be seen under outer clothing, the common waistline is also seamless, which increases comfort and reduces panty lines.

Figure 2A:
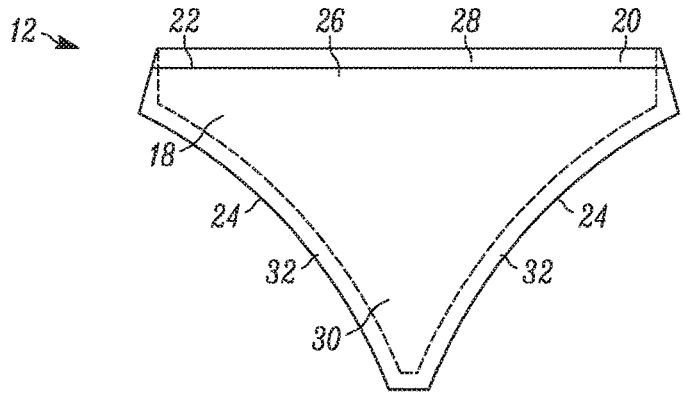
FIG. 2A is a schematic illustration showing an embodiment of the main support portion of FIG. 1.
Figure 2B:
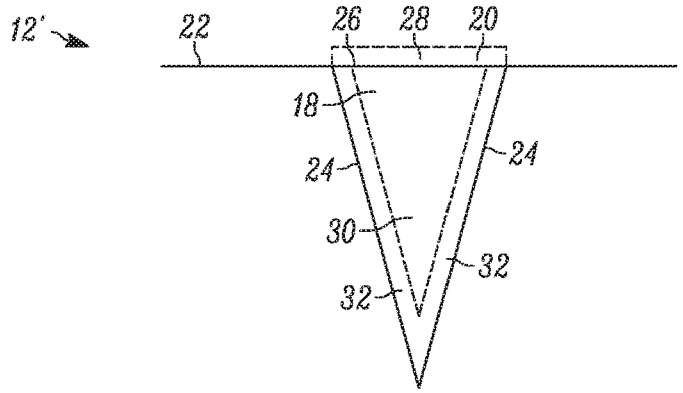
FIG. 2B is a schematic illustration showing an alternative embodiment of the main support portion of FIG. 1.
Figure 2C:
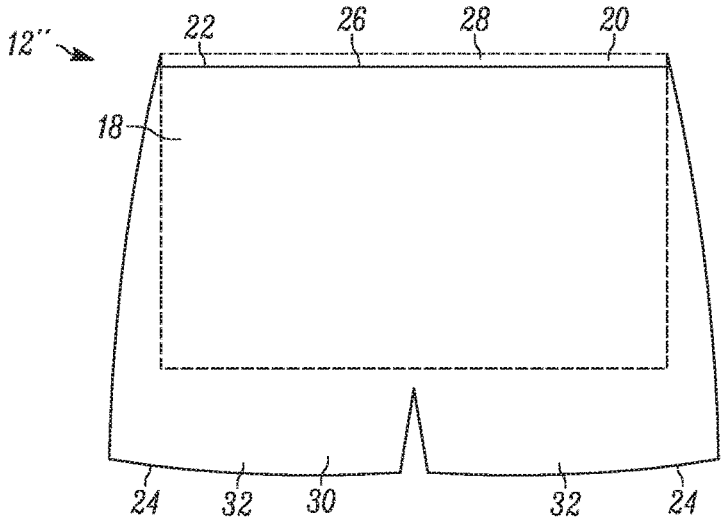
FIG. 2C is schematic illustration showing another alternative embodiment of the main support portion of FIG. 1.
Figure 3:
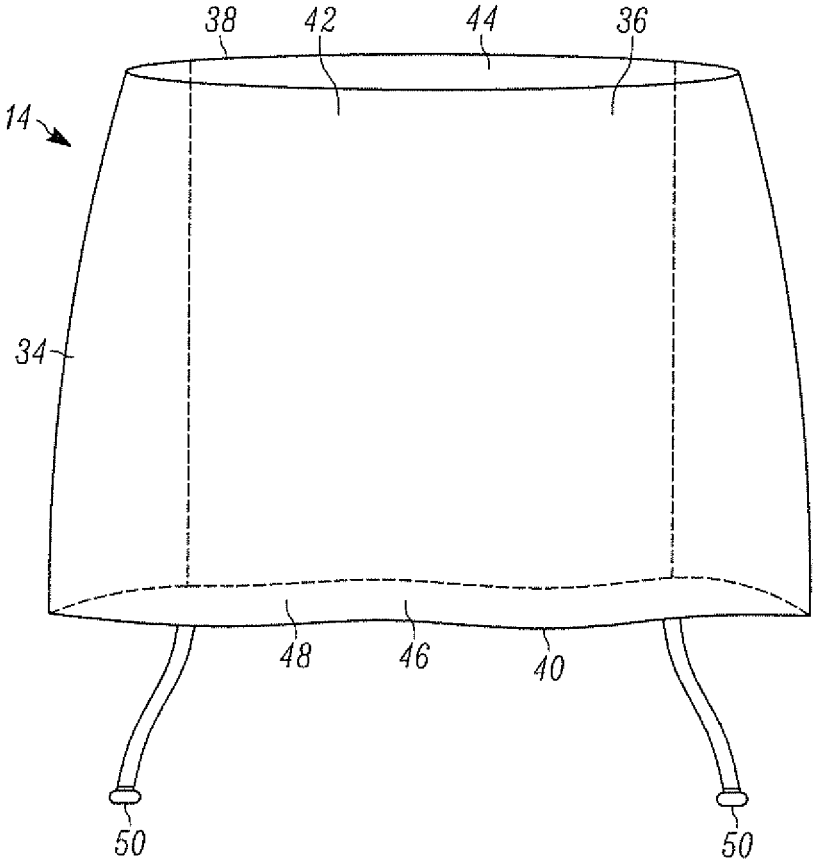
FIG. 3 is a schematic illustration showing the slip portion of the undergarment of FIG. 1.

In one aspect, the undergarment 10 includes a main support portion 12 (FIGS. 2A-B) formed from a single, seamless piece of material that is configured for attachment to a slip portion 14 (FIG. 3). The main support portion 12 (FIGS. 2A-B) can be configured as a panty including, but not limited to, a hipster brief (not shown), a bikini bottom (FIG. 2A), a thong 12' (FIG. 2B), or a pair of boy-shorts 12" (FIG. 2C). The main support portion 12 includes oppositely disposed front and back surfaces 18 and 20. The main support portion 12 also includes a top edge 22 connected to a pair of side edges 24. In some instances, the top edge 22 can be connected to the side edges 24 in a seamless manner. The top edge 22 extends around a waist portion 26 of the main support portion 12 to define a waist opening 28. The waist portion 26 of the main support portion 12 is configured for attachment to a portion of the slip portion 14. The side edges 24 extend around a leg portion 30 of the main support portion 12 to define a pair of leg openings 32. The main support portion 12 can have a generally triangular shape as shown in FIG. 2A; however, it will be appreciated that the main support portion 12 can have other shapes as well, such as circular, rectangular, square, etc., which increase the comfort level of the garment and coincide with current fashion trends. The main support portion 12 is made of any suitable stretch fabric and/or spandex-containing fabric (e.g., cotton, silk, etc.) that increases the comfort level of the undergarment 10 and coincides with current fashion trends.

In another aspect, the undergarment 10 includes a slip portion 14 (FIG. 3) formed from a single, seamless piece of material. The slip portion 14 is attached to the main support portion 12. The slip portion 14 includes oppositely disposed front and back surfaces 34 and 36. The slip portion 14 also includes a top edge 38 oppositely disposed from a bottom edge 40. The top edge 38 is configured to be attached to the top edge 22 of the main support portion 12. The top edge 38 extends around a waist portion 42 of the slip portion 14 to define a waist opening 44. The bottom edge 40 extends around a leg portion 46 of the slip portion 14 to define an opening 48. The slip portion 14 can have a generally rectangular shape as shown in FIG. 3; however, it will be appreciated that the slip portion 14 can have other shapes as well, such as circular, triangular, square, etc., which increase the comfort level of the garment and coincide with current fashion trends. The slip portion 14 is made of any suitable stretch fabric and/or spandex-containing fabric (e.g., cotton, silk, etc.) that increases the comfort level of the garment and coincides with current fashion trends. It will be appreciated that the main support portion 12 and the slip portion 14 can be made of the same or different materials.

The undergarment 10 can also include one or more garter clips 50. The garter clips 50 allow hosiery to be attached to the undergarment 10. The garter clips 50 may be detachable from, or integrally formed with the undergarment 10. In one instance, the garter clips can be attached at the leg portion 46 of the slip portion 14. In another instance, the garter clips 50 can be attached at the side edges 24 of the main support portion 12.

Figure 4:
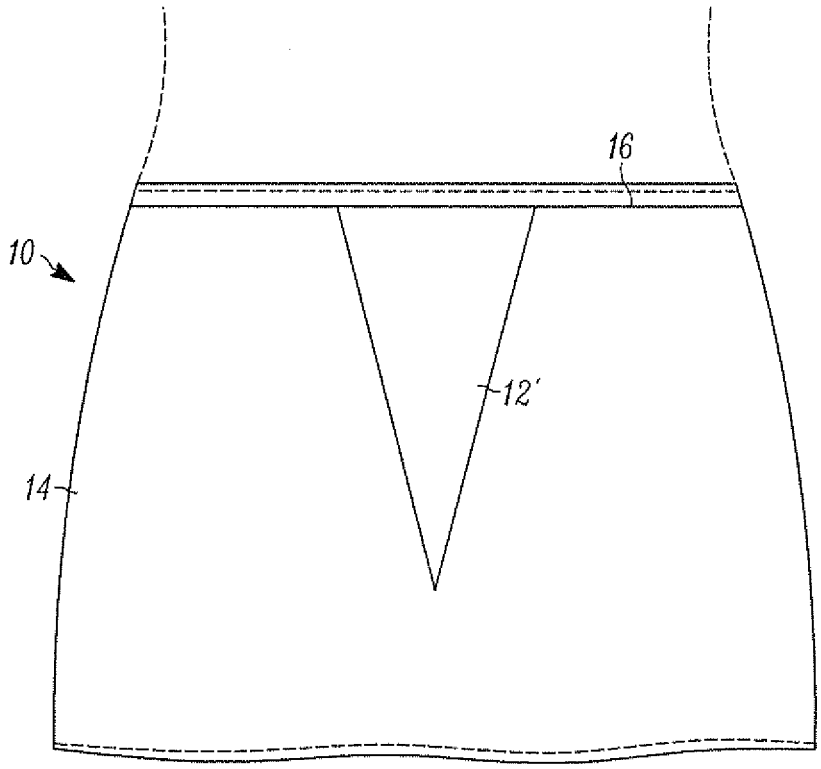
FIG. 4 is a schematic illustration showing an alternative embodiment of the undergarment of FIG. 1.
Figure 5:
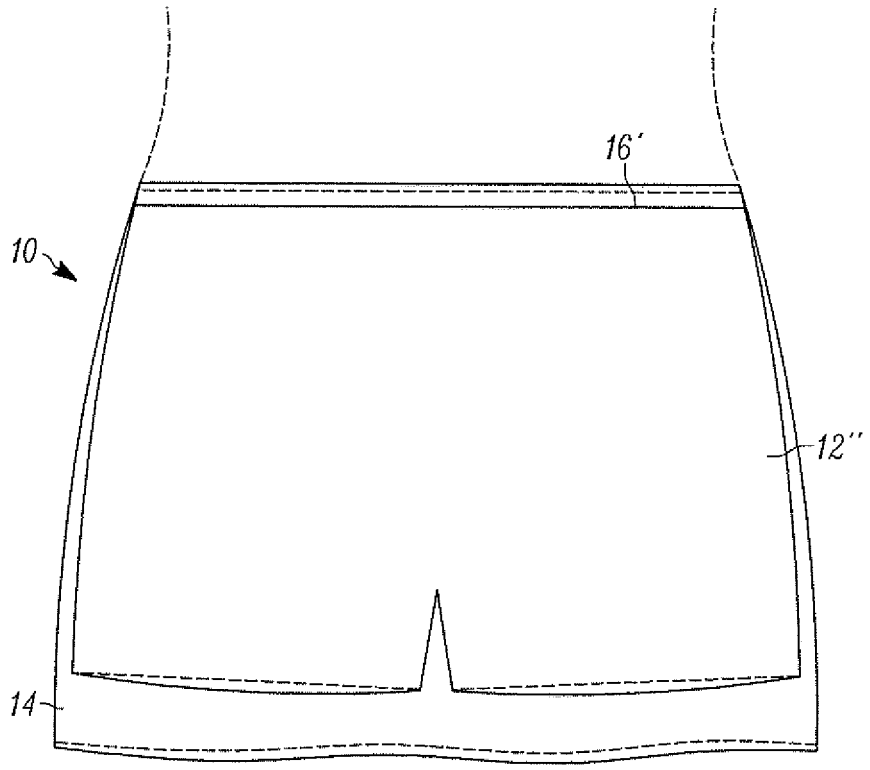
FIG. 5 is a schematic illustration showing another alternative embodiment of the undergarment of FIG. 1.

In use, the main support portion 12 and the slip portion 14 are joined together to form a single piece of clothing. In one example, the main support portion 12 and the slip portion 14 are joined together to form the undergarment 10. In another example, the main support portion 12 in the form of the thong 12' and the slip portion 14 are joined together to form the undergarment 10 (FIG. 4). In yet another example, the main support portion 12 in the form of the pair of boy-shorts 12" and the slip portion 14 are joined together to form the undergarment 10 (FIG. 5).

The main support portion 12 is attached to the slip portion 14 at a common, seamless waistline 16. The main support portion 12 and the slip portion 14 can be joined together by any suitable mechanism, such as sewing, knitting, adhesives, snaps, hook and loops, Velcro, etc., to form the common seamless waistline 16. The common seamless waistline 16 can also be non-compressive to provide more comfort for the wearer. The main support portion 12 and the slip portion 14 are assembled by placing the main support portion 12 inside of the slip portion 14 and attaching the waist portion 26 of the main support portion to the waist portion 42 of the slip portion. In one instance, the waist portion 42 of the slip portion 14 and the waist portion 26 of the main support portion 12 are securely attached to one another at only the common seamless waistline 16. Alternatively, the undergarment 10 can be provided with a single, common waistband 16' at the initial stages of manufacturing (FIG. 5). The material of each of the main support portion 12 and the slip portion 14 can be raw cut with a laser so elastic is not needed to hold the undergarment 10 together. Alternatively, the material of the main support portion 12 and the slip portion 14 can be cut so that the slip portion and the main support portion can form a singular garment with a common, seamless waistline 16.

In one example, the top edge 22 of the main support portion 12 and the top edge 38 of the slip portion 14 are joined together to form the seamless common waistline 16. The top edges 22 and 38 can be joined together continuously around lengths of the waist portions 26 and 42 of the main support portion 12 and the slip portion 14, respectively. Alternatively, the top edges 22 and 38 can be joined together at one or more discrete points around the waist portions 26 and 42 of the main support portion 12 and the slip portion 14, respectively. The leg openings 32 of the main support portion 12 and the opening 48 of the slip portion 14 can also be joined together in the same or a different manner as the waist portions 26 and 42 are joined together.

Figure 6:
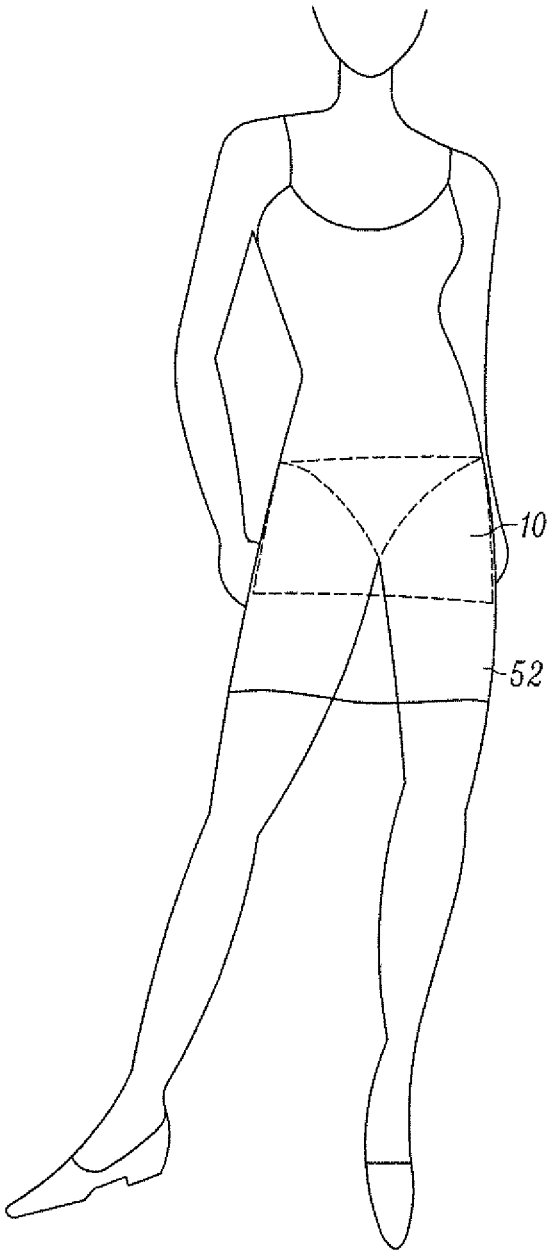
FIG. 6 is a schematic illustration showing a woman wearing the undergarment of FIG. 1 under a piece of clothing.

Now assembled, the undergarment 10 can be worn under a piece of clothing 52. In one example, the undergarment 10 can be worn under a piece of women's clothing 52, such as a skirt or a dress (FIG. 6). The undergarment 10 includes multiple layers and is opaque so that it is comfortable and not able to be seen under outer clothing. The seamless common waistline 16 increases the comfort of the undergarment 10 and reduces panty lines.

Figure 7:
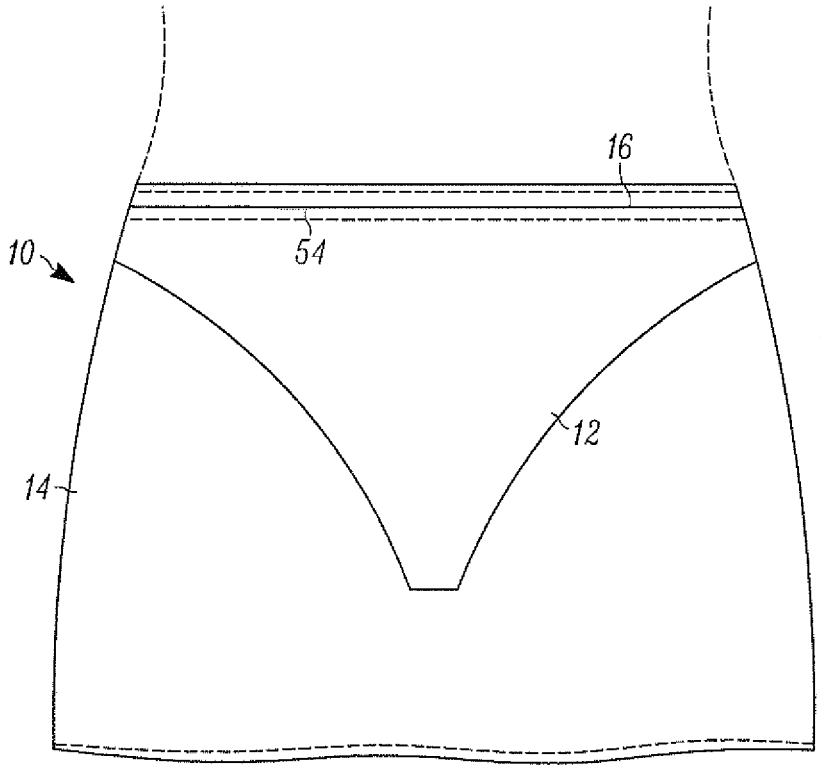
FIG. 7 is a schematic illustration showing another alternative embodiment of the undergarment of FIG. 1.

Although the waistline 16 has been described as being seamless, the waistline can alternatively include a hidden seam 54 (FIG. 7). The seam 54 is disposed on the inside of the undergarment 10 so that the seam is not visible. To form the seam 54, the waist portion 28 of the main support portion 12 and the waist portion 42 of the slip portion 14 are attached together by any suitable method (e.g., sewing, stitching, knitting, etc.). In one instance, the top edge 22 of the main support portion 12 and the top edge 38 of the slip portion 14 are attached together to form the seam 54. It will be appreciated that any portion of the waist portion 28 of the main support portion 12 and any portion of the waist portion 42 of the slip portion 14 can be attached together to form the seam 54. The seam 54 has a minimal thickness to increase the comfort of the undergarment 10 and reduce panty lines.

From the above description of the present disclosure, those skilled in the art will perceive improvements, changes, and modifications. Such improvements, changes, and/or modifications are within the skill of the art and intended to be covered by the appended claims.

What is claimed is:

1. A single undergarment to be worn under a piece of clothing, the undergarment comprising:

a main support portion including a waist portion and a leg portion; and a slip portion including a waist portion and a leg portion, the waist portion of the slip portion and the waist portion of the main support portion being securely attached to one another at only a common waistline;

wherein the undergarment terminates at the common waistline.

2. A single undergarment to be worn under a piece of clothing, the single undergarment consisting of:

a main support portion including a waist portion and a leg portion; and a slip portion including a waist portion and a leg portion, the waist portion of the slip portion and the waist portion of the main support portion being securely attached to one another at only a common waistline;

wherein the undergarment terminates at the common waistline.

3. The undergarment of claim 1, wherein the leg portion of the main support portion is free from attachment to the leg portion of the slip portion.

4. The undergarment of claim 1, wherein the undergarment is a pair of boy shorts and the leg portion includes a pair of leg openings located above a crotch of the main support portion, the main support portion including a top edge connected to a pair of side edges that extend around the leg portion of the main support portion to define the pair of leg openings.

5. The undergarment of claim 2, wherein the undergarment is a pair of boy shorts and the leg portion includes a pair of leg openings located above a crotch of the main support portion, the main support portion including a top edge connected to a pair of side edges that extend around the leg portion of the main support portion to define the pair of leg openings.

6. The undergarment of claim 1, wherein the entirety of the undergarment, when being worn, is located on and/or below the waist of the wearer.

7. The undergarment of claim 2, wherein the entirety of the undergarment, when being worn, is located on and/or below the waist of the wearer.

8. The undergarment of claim 1, being an undergarment selected from the group consisting of a hipster brief, a bikini bottom, a thong, and a pair of boy-shorts.

9. The undergarment of claim 2, being an undergarment selected from the group consisting of a hipster brief, a bikini bottom, a thong, and a pair of boy-shorts.

10. The undergarment of claim 1, wherein the undergarment is a hipster brief and the leg portion includes a pair of leg openings located above a crotch of the main support portion, the main support portion including a top edge connected to a pair of side edges that extend around the leg portion of the main support portion to define the pair of leg openings.

11. The undergarment of claim 1, wherein the undergarment is a bikini bottom and the leg portion includes a pair of leg openings located above a crotch of the main support portion, the main support portion including a top edge connected to a pair of side edges that extend around the leg portion of the main support portion to define the pair of leg openings.

12. The undergarment of claim 1, wherein the undergarment is a thong and the leg portion includes a pair of leg openings located above a crotch of the main support portion, the main support portion including a top edge connected to a pair of side edges that extend around the leg portion of the main support portion to define the pair of leg openings.

13. The undergarment of claim 2, wherein the undergarment is a hipster brief and the leg portion includes a pair of leg openings located above a crotch of the main support portion, the main support portion including a top edge connected to a pair of side edges that extend around the leg portion of the main support portion to define the pair of leg openings.

14. The undergarment of claim 2, wherein the undergarment is a bikini bottom and the leg portion includes a pair of leg openings located above a crotch of the main support portion, the main support portion including a top edge connected to a pair of side edges that extend around the leg portion of the main support portion to define the pair of leg openings.

15. The undergarment of claim 2, wherein the undergarment is a thong and the leg portion includes a pair of leg openings located above a crotch of the main support portion, the main support portion including a top edge connected to a pair of side edges that extend around the leg portion of the main support portion to define the pair of leg openings.

* * * * *